US011332991B2

(12) United States Patent
Seren et al.

(10) Patent No.: US 11,332,991 B2
(45) Date of Patent: May 17, 2022

(54) TARGETED DOWNHOLE DELIVERY WITH CONTAINER

(71) Applicant: Saudi Arabian Oil Company, Dhahran (SA)

(72) Inventors: Huseyin Rahmi Seren, Houston, TX (US); Thomas Hillman, Missouri City, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/514,752

(22) Filed: Jul. 17, 2019

(65) Prior Publication Data

US 2021/0017827 A1 Jan. 21, 2021

(51) Int. Cl.
*E21B 27/02* (2006.01)
*E21B 41/02* (2006.01)

(52) U.S. Cl.
CPC ..... *E21B 27/02* (2013.01); *E21B 41/02* (2013.01)

(58) Field of Classification Search
CPC ..... E21B 34/10; E21B 27/02; E21B 41/02
See application file for complete search history.

(56) References Cited

U.S. PATENT DOCUMENTS 4,187,909 A * 2/1980 Erbstoesser ..... E21B 27/02 137/268
4,611,664 A * 9/1986 Osterhoudt, III ..... C09K 8/536 166/162
5,188,837 A 2/1993 Domb
6,534,980 B2 3/2003 Toufaily et al.
7,049,272 B2 5/2006 Sinclair et al.
7,376,514 B2 5/2008 Habashy et al.
8,237,444 B2 8/2012 Simon
8,794,062 B2 8/2014 DiGoggio et al.
8,884,624 B2 11/2014 Homan et al.
9,562,987 B2 2/2017 Guner et al.
2006/0213662 A1 9/2006 Creel et al.
2008/0047337 A1 2/2008 Chemali et al.
2009/0302847 A1 12/2009 Knizhnik
2011/0221443 A1 2/2011 Bittar
2011/0100634 A1 5/2011 Williamson
2012/0285695 A1 11/2012 Lafferty et al.
2014/0110102 A1 4/2014 Hall
2016/0109611 A1 4/2016 Simon
2016/0251935 A1* 9/2016 Jacob ..... E21B 27/02 166/373
2018/0292558 A1 10/2018 Wilson et al.
2018/0306027 A1* 10/2018 Sherman ..... E21B 29/02

FOREIGN PATENT DOCUMENTS

EP 3196402 A1 * 7/2017 ..... E21B 27/02
WO 2013126388 8/2013

OTHER PUBLICATIONS

PCT International Search Report and Written Opinion in International Appln. No. PCT/US2020/041984, dated Oct. 22, 2020, 18 pages.

* cited by examiner

*Primary Examiner* — Dany E Akakpo
(74) *Attorney, Agent, or Firm* — Fish & Richardson P.C.

(57) ABSTRACT

A system and method for targeted delivery of treatment material to a specified depth in a wellbore, including placing a container to the specified depth and allowing the container to fail at the depth due to wellbore pressure to release the treatment material.

14 Claims, 9 Drawing Sheets

TARGETED DOWNHOLE DELIVERY WITH CONTAINER

TECHNICAL FIELD

This disclosure relates to targeted downhole delivery in a wellbore.

BACKGROUND

A borehole or wellbore may receive different types of treatments including chemical treatments. In some instances, a specific location or section of the wellbore may benefit from the treatment. Improved delivery of the treatments into the wellbore or adjacent geological formation may facilitate the exploration and production of crude oil and natural gas.

SUMMARY

An aspect relates to a method of targeted delivery of treatment material to a specified depth in a wellbore, including placing a container having the treatment material into the wellbore and flowing the container to the specified depth. The method includes allowing the container to rupture at the specified depth due to the wellbore pressure at the specified depth. Further, the method includes allowing the treatment material to release from the container through a rupture opening of the container.

Another aspect relates to a method of applying a targeted-delivery container to a wellbore, including introducing the targeted-delivery container storing a treatment chemical into a wellbore fluid in the wellbore. The method includes rupturing the targeted-delivery container by wellbore pressure at a designated location in the wellbore to provide the treatment chemical from the targeted-delivery container into contact with the wellbore fluid at the designated location.

Yet another aspect relates to a method of preparing a targeted-delivery container for a wellbore, including fabricating the targeted-delivery container as having a treatment material in an internal cavity of the targeted-delivery container. The treatment material is for the wellbore or adjacent geological formation. The method includes fabricating the targeted-delivery container with the treatment material in combination as having an effective density greater than density of the wellbore fluid. Further, the method includes fabricating the targeted-delivery container having a wall thickness to fail at a specified wellbore pressure. In application, the failure of the container will expose the treatment material in the internal cavity of the container to wellbore fluid in the wellbore at a wellbore depth associated with the specified wellbore pressure.

Yet another aspect relates to a wellbore targeted-delivery container having an inner cavity holding a treatment material for a wellbore. The effective density of the wellbore targeted-delivery container having the treatment material is greater than density of the wellbore fluid. The targeted-delivery container has a wall (or portion of a wall) having a thickness to rupture at a specified wellbore pressure due to a pressure differential between the wellbore and the inner cavity of the container to release the treatment material into contact with the wellbore fluid in the wellbore.

Yet another aspect relates to a targeted-delivery system for a wellbore. The targeted-delivery system includes multiple targeted-delivery containers. Each targeted-delivery container has an inner cavity holding a treatment material to be directed to a designated section of the wellbore. The effective density of each of the multiple targeted-delivery containers having the treatment material is greater than density of a wellbore fluid in the wellbore. Further, each targeted-delivery container has a wall region to fracture due to differential pressure between the designated section of the wellbore and the inner cavity of the container to expose the inner cavity to the wellbore fluid in the designated section. That wall region of the container has less thickness than other wall regions of the respective targeted-delivery container.

The details of one or more implementations are set forth in the accompanying drawings and the description forthcoming. Other features and advantages will be apparent from the description and drawings, and from the claims.

BRIEF DESCRIPTION OF DRAWINGS

Like reference numbers and designations indicate like elements.

DETAILED DESCRIPTION

Figure 1:
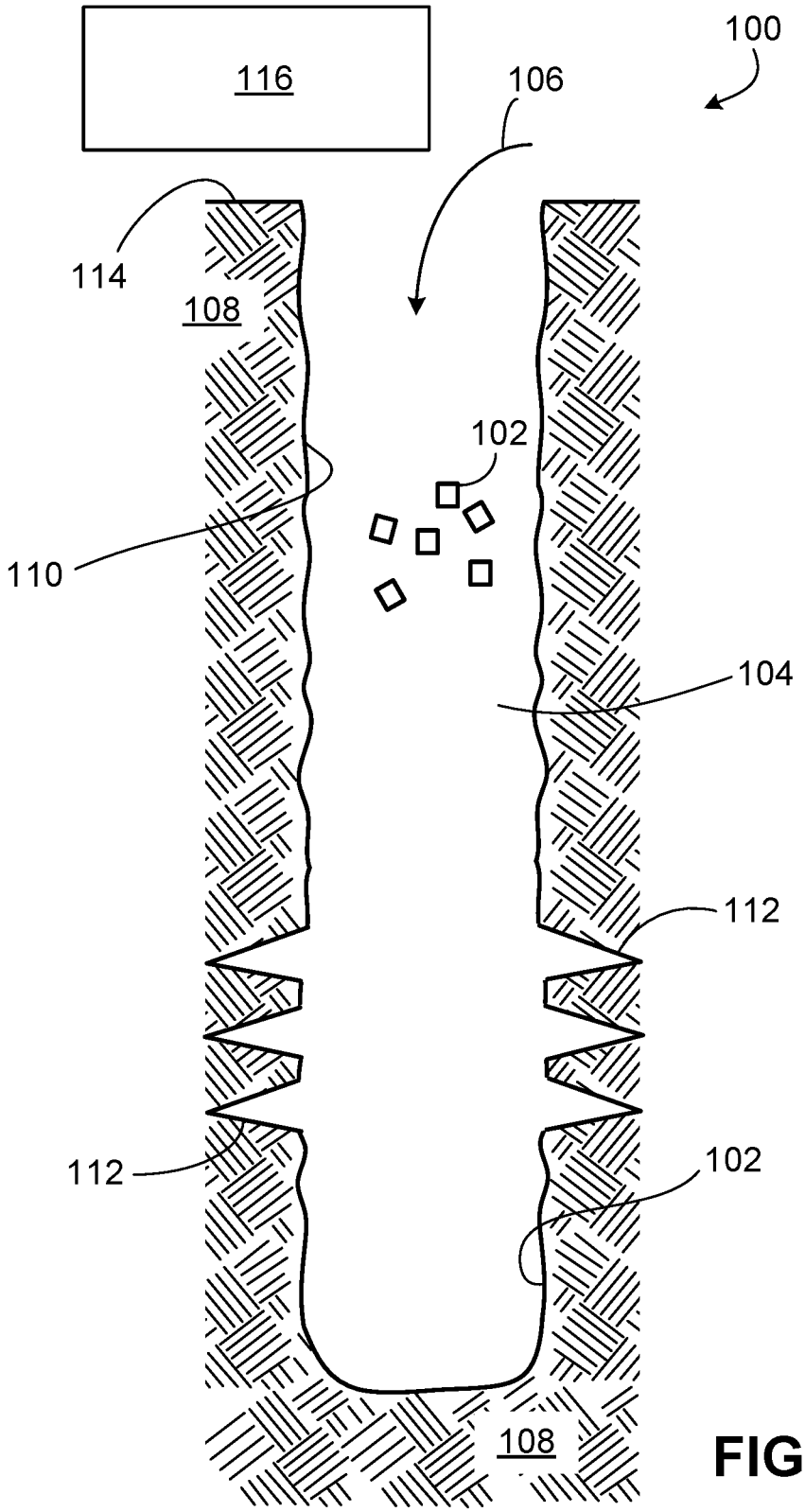
FIG. 1 is a diagram of a well site in which containers having treatment material may be applied for targeted delivery in a wellbore at the well site.

This disclosure relates to a device and method for targeted downhole delivery in a borehole or wellbore. Wells may be treated with chemicals to increase the formation permeability, remove scale build-up, inhibit corrosion, or address loss circulation. The treatment may be beneficial at a particular depth or zone of the well. Yet, the treatment in practice may be received by much of the well because the chemicals are dispersed (for example, pumped) from the surface through the wellbore fluid into the wellbore. Therefore, more chemical may be spent than needed to treat the problematic zone. Also, areas that do not need treatment can be negatively affected due to exposure to the chemical. For example, acid to remove scale at a particular section can corrode other sections without scale. In order to avoid these problems, present embodiments localize the treatment to a specified depth in the well or wellbore.

Embodiments of the present techniques contain treatment chemicals in packages to prevent or reduce exposure (reaction) of the treatment chemicals with unwanted sections of a well. The packages (containers) may have dimensions (for example, length, width, height, or diameter) less than 200 millimeters (mm) or less than 50 mm. The containers may be designed to release the chemicals passively at a desired depth or hydrostatic pressure point. In addition, the container (packaging) material can be made of dissolvable material such that the container will dissolve over time (for example, at least 3 days) to eliminate or reduce contamination of the well by the container.

Certain embodiments provide that treatment chemicals in the form of solid, liquid, or gas are contained in the packages. If the chemical is a solid or fluid, a more compressible fluid (for example, air or nitrogen) may be placed alongside the chemical inside the package or container. The containers may be sealed at a pressure less than the wellbore pressure at the targeted depth of the wellbore. When the container flows into the wellbore, an increasing differential pressure between outside and inside of the container will be realized as the container reaches greater depths into the wellbore.

The containers may be manufactured to comply up to a design external pressure or to a design differential pressure across the container wall. When the packages are subjected to actual conditions in the wellbore that reach the design external pressure or design differential pressure, the containers may fail resulting in the release and mixing of the contained chemical with the downhole environment. The desired failure of the container may be characterized as a fracture, rupture, or implosion of the container due to the positive differential pressure of the external pressure greater than the internal cavity pressure of the container.

The containers can be made out of metals, plastics, glass, silicon, or syntactic foam. The effective density of the container having the included treatment chemical can be set or specified greater than the wellbore fluids, such that the delivery of the containers into the wellbore can be without a pump in certain embodiments.

The containers as ruptured including any container pieces can return to the Earth surface with the flow of fluids in the well. This flow can be natural due to reservoir pressure or can be due to a differential pressure generated by a pump. A screen can be placed on surface pipelines to collect the ruptured containers and pieces for removal. Alternatively (or in addition), the container or packaging (for example, made of polyvinyl alcohol or aluminum alloys) can be dissolvable in water to avoid pollution of the well with the ruptured packaging. For example, the ruptured container may dissolve over a period of 3 days to 2 weeks.

Some well treatments have relied on emulsions without containers. However, control of emulsion chemistry may be a challenge for a wide variety of wells with varying fluids, temperatures, and pressures. Also, the emulsions are typically pumped downhole, whereas the present containers may be applied without a pump in certain implementations. Yet, a pump may be employed for delivery of the present containers, such as for the pump to speed application or push the released chemical(s) into the formation. In some implementations, a flow injector on a conduit downstream of a pump can provide the containers into the wellbore.

Some applications my employ containers that dissolve in the short term (for example, less than one hour) to deliver chemicals downhole and to release the chemical via the short-term dissolving of the containers. However, embodiments of the present containers do not rely on dissolving of the containers to release the chemical(s) from the container. Instead, embodiments may rely on the hydrostatic pressure in the wellbore to rupture the containers which can give better control over the depth of the delivery and release of the treatment chemicals than with dissolving of the containers.

Turning now to the drawings, FIG. 1 is a well site 100 in which containers 102 having treatment material (for example, chemical(s)) inside the containers 102 may be applied for targeted delivery in a wellbore 104. In the illustrated implementation, the containers 102 may be introduced or pumped into the wellbore 104, as indicated by arrow 106. The effective density of the containers 102 with the treatment material held inside the containers 102 may be greater than the density of the wellbore fluid. In that case, the containers 102 may flow or migrate downward through wellbore fluid (without aid of a pump) to greater depths in the wellbore 104. In operation, the containers 102 may rupture at a desired depth or zone in the wellbore 104 to release the contained material. The wellbore 100 pressure at the desired depth may rupture the containers 102.

Upon rupturing or puncturing of the container 102 (due to external pressure), the treatment material or chemical may release, discharge (be displaced), or flow from an inner cavity of the container 102 through the ruptured opening of the container 102. In some implementations, wellbore fluid may flow into the inner cavity of the ruptured container 102 to displace the treatment material from the inner cavity.

In one embodiment, a wall thickness of the container 102 is thinner at a portion of the container 102 so that the container 102 may rupture at that portion. In other embodiments, the wall thickness is generally the same throughout the container and the rupturing or failure of the container may occur at any portion of the container due to increased external pressure.

The materials or chemicals released from containers 102 may be for different treatments and applications. Applications may be to increase permeability of the formation 108 including adjacent the wellbore 104, remove scale build-up or inhibit corrosion such as on a casing, address loss circulation, or promote primary or remedial cementing.

The wellbore 104 may be openhole or cased. An openhole formed in a geological formation 108 may be defined by the formation surface 110 as a wall of the wellbore 104. The wellbore 104 as cased (casing not shown) may be cemented between the casing and the formation surface 110. The wellbore 104 may have perforations 112 through the casing into the formation 108.

The wellbore 104 may drilled through the Earth surface 114 into the Earth crust having the geological formation 108. The geological formation 108 may have hydrocarbons such as crude oil and natural gas. A borehole or wellbore 104 may be drilled into a geological formation 108 or hydrocarbon reservoir in the Earth for the exploration or production of oil and gas. Oil and natural gas drilling-rigs create holes to identify geologic reservoirs and that allow for the extraction of oil or natural gas from those reservoirs.

Surface equipment 116 may be associated with the wellbore 104 for drilling the wellbore 104 and the subsequent installation of casing into the wellbore 104. The surface equipment 116 may include a mounted drilling rig which may be a machine that creates boreholes in the Earth subsurface. The term "rig" may refer to equipment employed to penetrate the Earth surface 114 of Earth crust. To form a hole in the ground, a drill string having a drill bit may be lowered into the hole being drilled. In operation, the drill bit may rotate to break the rock formations to form the hole as a borehole or wellbore 104. In the rotation, the drill bit may interface with the ground or formation 108 to grind, cut, scrape, shear, crush, or fracture rock to drill the hole. An openhole wellbore 104 having the surface 110 of the formation 108 as a wall of an openhole wellbore 104 may be drilled and formed through the Earth surface 108 into the hydrocarbon formation 108.

In operation of the drilling, a drilling fluid (also known as drilling mud) is circulated down the drill string to the bottom of the wellbore 104. The drilling fluid may then flow upward toward the surface through an annulus formed between the drill string (not shown) and the formation surface 110. The drilling fluid may cool the drill bit, apply hydrostatic pressure upon the formation 108 penetrated by the wellbore, and carry formation 108 cuttings to the surface. In addition to the drilling rig, surface equipment 116 may include tanks, separators, pits, pumps, and piping for circulating drilling fluid (mud) through the wellbore 104.

A casing may be lowered into the wellbore 104 and cement slurry applied to the annulus between the casing and the formation surface 110. The surface equipment 116 may include a supply of cement slurry to cement the annulus between the casing (not shown) and the formation surface 110 of the wellbore 104. Oil-well cementing may include mixing a slurry of cement and water. The slurry may be pumped down the wellbore 104 casing, tubing, or drill pipe to a specified elevation or volume in the well. Primary cementing may involve casing cementation. Primary cementing may be the cementing that takes place soon after the lowering of the casing into the formation 108 and may involve filling the annulus between the casing and the formation 108 with cement.

Figure 2:
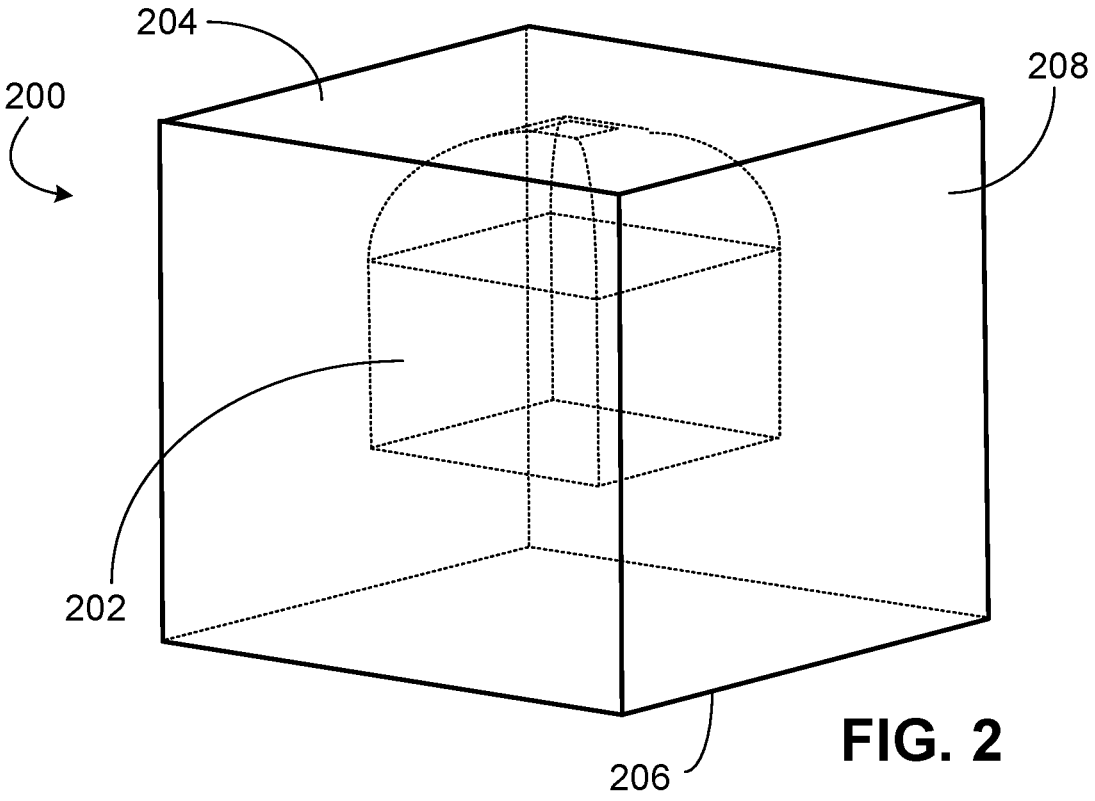
FIG. 2 is a diagram of an example targeted-delivery container having an inner cavity for holding treatment materials or chemicals.

FIG. 2 is an example of a targeted-delivery container 200 having an inner cavity 202 for holding treatment materials or chemicals. The container 200 is an example of the container 102 discussed with respect to FIG. 1. In the illustrated embodiment of FIG. 2, the container 200 is generally cuboid in shape having six sides which may be labeled as a top 204, bottom 206, and fours sides 208. In this embodiment, a central region of the top 204 has a thinner wall thickness (for example, 300 microns) than the six sides generally. In the illustrated implementation, the cavity 202 has a combined shape of a lower cube portion near the center of the container 200 with an upper dome portion toward the top 204. The cavity 202 may instead be other shapes such as spherical or cuboid without the dome portion.

In some implementations, the length and width of each side 204, 206, 208 is in the range of 0.5 centimeter (cm) to 10 cm. In particular implementations, the length of each side is in the range of 1 cm to 3 cm (for example, 2 cm) and the width of each side is the range of 1 cm to 3 cm (for example, 2 cm). Moreover, the shape may be other than cuboid, such as cylindrical, spherical, or irregular. The wall thickness of one or more of the sides 204, 206, 208 may be at least 1 mm or at least 2 mm. The wall thickness of the sides 204, 206, 208 may be in the range of 0.5 mm to 10 mm, or at least 10 mm. As indicated, one or more of the walls or potions of walls may have different thicknesses in comparison. For instance, a portion of the wall may be the thinnest (for example, in a range of 50 microns to 1 mm, or at least 100 microns) such that the container 200 fails (for example, ruptures, fractures, or implodes) at that portion of the wall under the external hydrostatic pressure.

Figure 3:
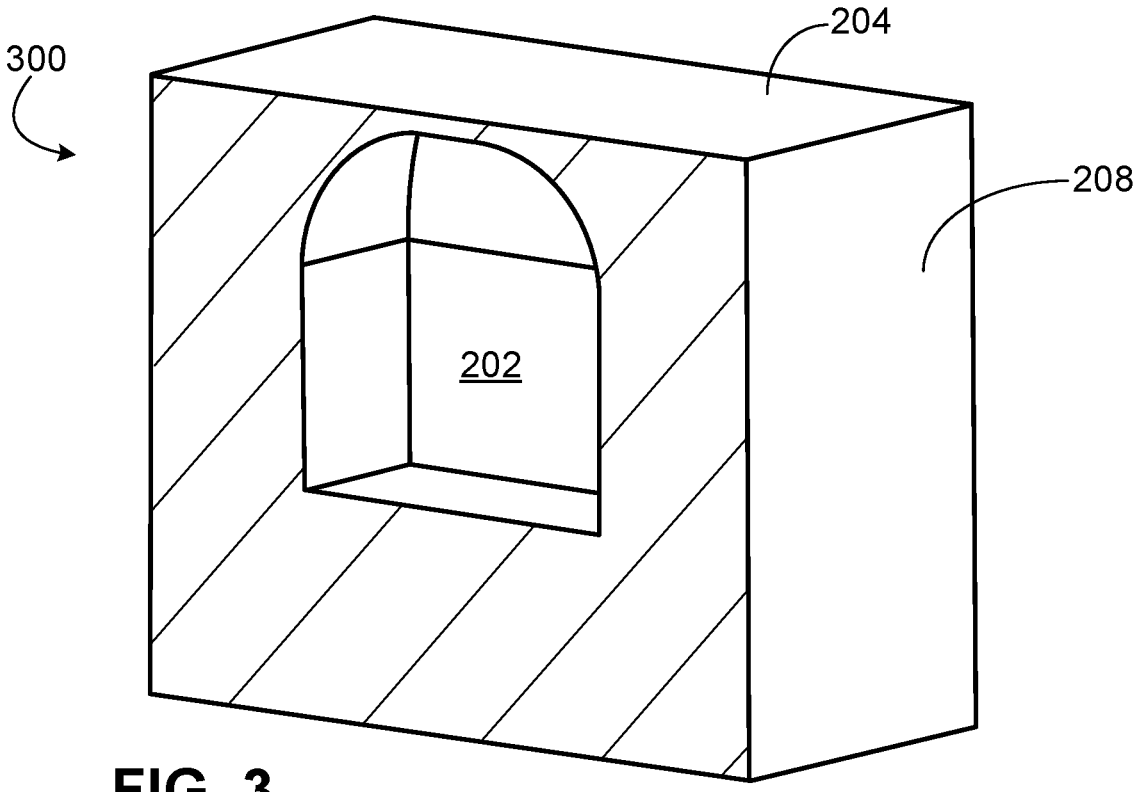
FIG. 3 is a cross-sectional view of the container of FIG. 2, the cross section taken through the inner cavity.

FIG. 3 is a cross-sectional view 300 of the container 200 of FIG. 2. The cross section is taken through the inner cavity 202. The cross-sectioned surface with forward slash lines encompasses a width and a height of the container 200. The depth of the cross-sectional view 300 is about half of the depth of the perspective view of FIG. 2.

In this implementation, the wall thickness is the least (for example, 300 microns) on the top 204 side, in particular, at the flat apex of the inner cavity 202 dome. In some embodiments, the wall thickness at the flat apex is in the range of 200 microns to 600 microns and the wall thickness of the remaining five sides is at least 2 mm, at least 3 mm, or in the range of 1.5 mm to 5 mm. In those embodiments, the thicker walls (for example 2 mm or 3 mm) on the five sides withstand a greater pressure differential than the thinner wall (for example 300 microns and acting as a membrane) on the one side (for example, top 204) of the container 200.

Turning now to an Example (FIGS. 4 and 5) of the present containers. In the Example, targeted-delivery containers 402 depicted in FIG. 4 were fabricated via three dimensional (3D) printing (also known as additive manufacturing) of improved copolyester (CPE+) material. The CPE+ material has greater temperature resistance and impact strength as compared to standard copolyester (CPE). The 3D printing was fused deposition modeling (FDM). In the Example, the containers 402 were fabricated as a cube with side length of 1 cm and a wall thickness of 3 mm except that a portion of one side wall had a thickness of 300 microns. This thinner wall acted as a membrane. Compared to the thick walls, the membrane experienced greater strain and stress in application and was ruptured under the specified external hydrostatic pressure. In the Example, the containers 402 were exposed to a hydrostatic pressure of 3000 pounds per square inch gauge (psig) in an oil-filled pressure chamber to rupture the membrane (see FIG. 5). The designed failure of the container may be characterized as a fracture, or rupture of the container into the container due to the positive differential pressure experienced that is the external pressure greater than the internal cavity pressure of the container.

Figure 4:
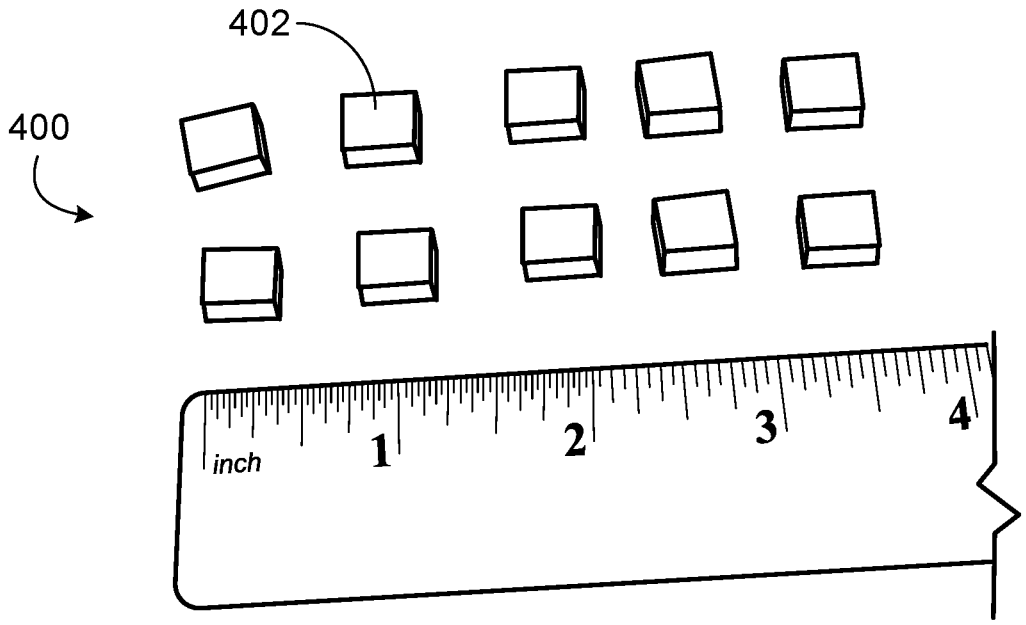
FIG. 4 is a perspective view of an Example of ten targeted-delivery containers (pre-ruptured) which may be analogous to the containers of FIG. 1, 2, or 3.

FIG. 4 is a perspective view 400 of ten targeted-delivery containers 402 of the Example. The containers 402 may be analogous to the container 200 of FIGS. 2 and 3 and the container 102 of FIG. 1. The containers 402 are pre-ruptured in that the containers 402 are containers that have not yet been ruptured or failed. The containers 402 have an inner cavity which may hold a treatment material or chemical(s) for targeted delivery downhole into a wellbore. In this Example, the inner cavity of the containers 402 have the shape of the container inner cavity 202 shown in FIGS. 2 and 3.

Figure 5:
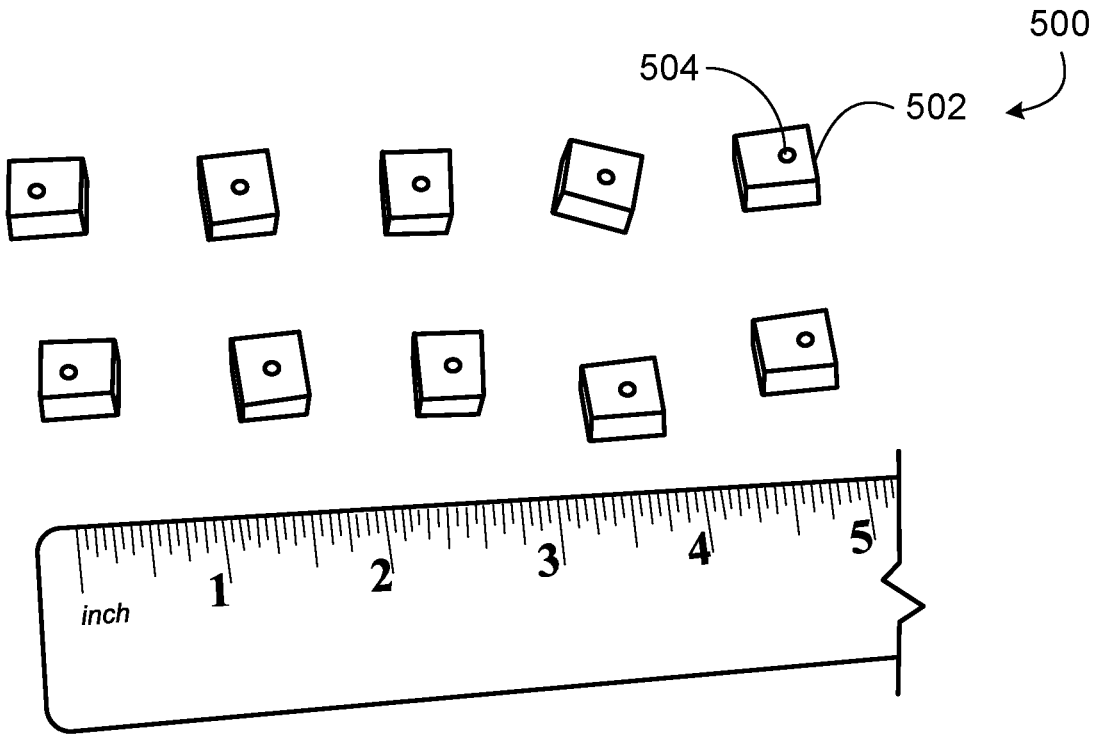
FIG. 5 is a perspective view of the ten ruptured containers of FIG. 4 but as ruptured.

FIG. 5 is a perspective view 500 of ten ruptured containers 502 which are the targeted-delivery containers 402 of FIG. 4 but as ruptured with a ruptured opening 504 to the internal cavity. For the Example, the containers 402 were exposed to an external pressure of 3000 psig to rupture the containers to give the ruptured containers 502 as depicted in FIG. 5. In this Example, the containers 502 ruptured at a wall having the thinnest thickness (300 microns) of the walls, in particular, at a portion of a wall adjacent the flat apex of a dome of the cavity (as in FIGS. 2 and 3). For this Example, that portion of the wall had a thickness of about 300 microns, whereas the wall thickness around the container 402, 502 was about 3 mm.

Figure 6:
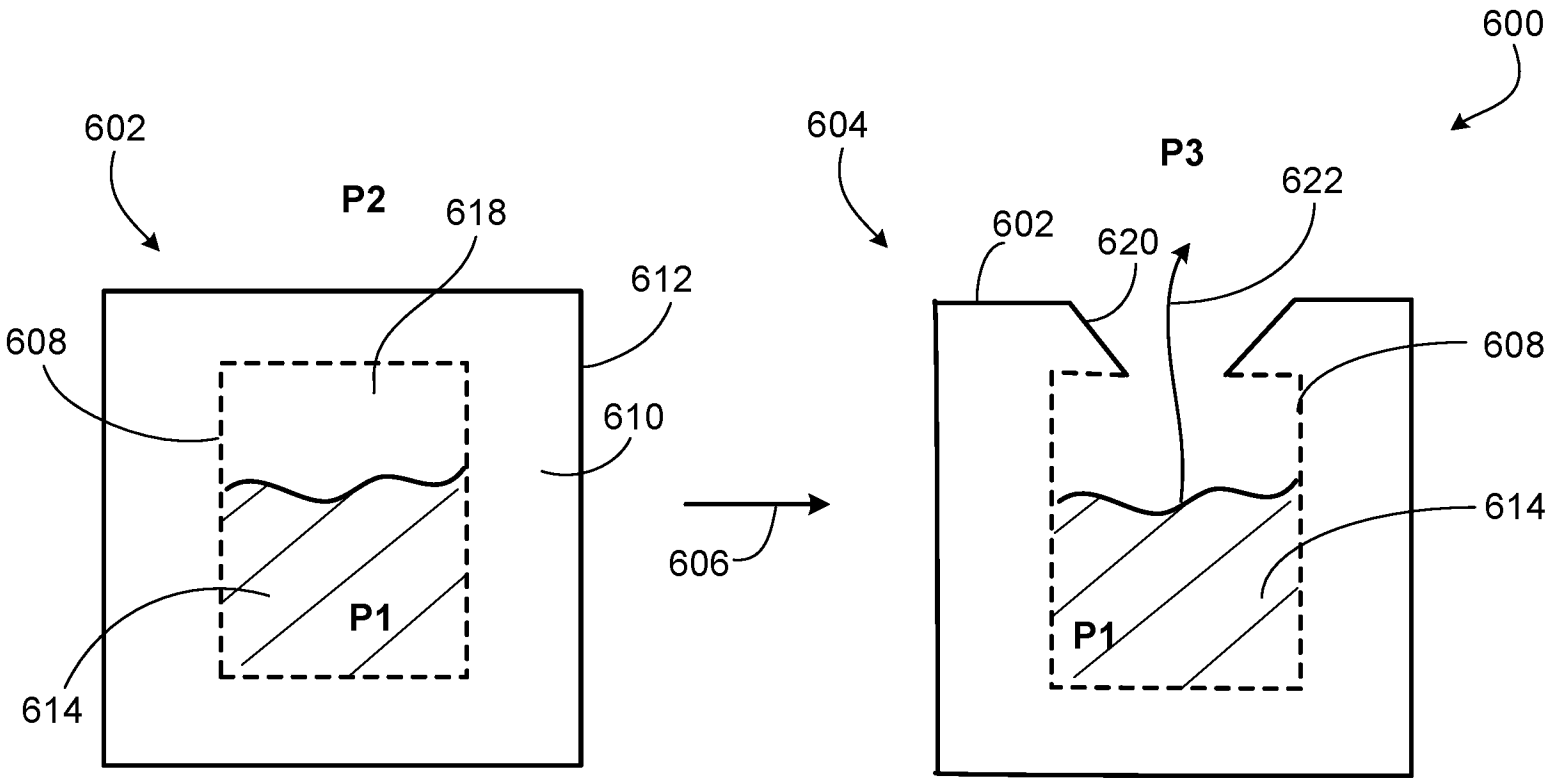
FIG. 6 is a sequence diagram of a targeted-delivery container subjected to external pressure to give a ruptured targeted-delivery container.

FIG. 6 is a sequence diagram 600 of a targeted-delivery container 602 subjected to external pressure to give a ruptured targeted-delivery container 604. The application of external pressure (for example, external hydrostatic pressure) is indicated by arrow 606. The container 602 has an inner cavity 608 surrounded by a wall thickness 610 and outer surface 612. The wall thickness 610 may vary around the inner cavity 608. A treatment material 614 is held in the inner cavity 608. The treatment material 614 may be a fluid or a solid, or both. The fluid may be liquid, gas, or a supercritical fluid, or any combinations thereof. In some implementations, a volume portion 618 of the cavity 608 may be a vapor space, an additional gas, or a pressurized gas. In other implementations, there is no volume portion 618 having a vapor space or gas.

During manufacture, the container 602 may be fabricated or sealed with the cavity 608 having the treatment material 614 and any additional fluid (for example, compressible gas) at a pressure P1. The pressure P1 in the cavity 608 can be atmospheric, a positive pressure, or a negative pressure (vacuum). Atmospheric pressure is 1 atmosphere (atm) or about 14.7 pounds per square inch absolute (psia). A positive pressure is greater than 1 atm. A negative pressure is less than 1 atm. At the Earth surface of the well site prior to placement of the container 602 into the wellbore, the pressure P2 external to the container 602 may generally be atmospheric. The pressure differential across the walls of the container 604 at the Earth surface is P2 minus P1.

In application, the container 602 (for example, at least ten containers 602) are placed into the wellbore. The external pressure (wellbore hydrostatic pressure) on the container 602 increases as the container 602 reaches greater depth in the wellbore. The container 602 is ruptured by the wellbore pressure of P3 to give the ruptured container 604 having a ruptured opening 620 exposing the inner cavity 608. The wellbore pressure of P3 may be at the desired depth or specified location of the wellbore for release 622 of the treatment material 614 from the ruptured container 604. The pressure P3 at the specified location may be known in advance so to specify a container 604 that will fail at the specified location. The pressure P3 may be known by measurement via pressure sensor(s) at the wellhead or along the wellbore and via hydraulic calculations. Example wellbore pressures are up to 7000 psig or greater. The wellbore pressure may be due to hydrostatic pressure of wellbore fluid, formation fluid, or pumped fluid.

At the targeted depth in the wellbore, the pressure differential across the container walls for the failure (rupture) of the container 602 to give the punctured container 604 is P3 minus P1. The rupture of the container 602 may be characterized as a failure or rupture of the container into the container due to the positive differential pressure with the external pressure P3 greater than the internal cavity pressure P1.

As mentioned, the wellbore pressure (hydrostatic pressure) P3 at the target location (depth) in the wellbore may be known in advance such that the container 602 can be designed and fabricated for failure at the pressure differential at the target location. In the fabrication of the container 602, the specification of the cavity 608 pressure can be varied so to accommodate different pressure differentials for failure (rupture). In one implementation, the cavity 608 can be closed with the container 602 in a pressurized-gas environment to give the specified pressure of the cavity 608. Depending on the targeted differential pressure, the pressure inside the container 602 can be adjusted during the manufacturing process.

For example, the fabrication of the container can be performed inside a gas chamber. Thus, the cavity 608 as then sealed may generally have the same pressure as the gas chamber. In one implementation, a 3D printer is placed in a gas chamber to manufacture the containers 602 and seal the cavities 608 with gas.

A nozzle can be added on 3D printers to fill cavities 608 with fluid during the printing. The filling of the cavity with fluid or treatment material can be performed after the 3D printing. A port can be added to a side of the container 602, for example, with a stem valve or check valve to allow for adjusting of the internal pressure in the cavity 608.

The design and fabrication of the container 602 for failure of a container 602 wall at different pressure differentials may be related to the specified container material of construction, container geometry, container wall thickness, and container membrane thickness (for example, 300-micron). The membrane may be a portion of a container 602 wall side having less thickness than the remaining portion of that container 602 wall side and less thickness than the other wall sides of the container 602. In one implementation, the membrane is an entire one of the six wall sides.

In certain implementations, the thickness of a container 602 wall membrane may be varied in fabrication to give failure at different pressure differentials. Design and fabrication calculations may involve membrane calculations, vessel pressure-rating calculations, or finite element analysis (FEA). In some implementations, the thinnest portion of the container 602 wall for failure is not characterized as a membrane. In one implementation, the sides of the container 602 have the same thickness but a rupture disc with a set pressure for implosion is incorporated on one side of the container 602. Typical rupture discs are employed in hydraulic systems to prevent overpressure of a vessel or container and may be designed to rupture within a specified range of pressure.

The containers 102, 200, 602 may be fabricated, for example, by machining, 3D printing, fiber filament winding, or molding such as injection molding or compression molding. The treatment chemicals may be introduced into the internal cavity 202, 608 and the pressure set in the cavity during or after fabrication.

In certain embodiments, the volume of the cavity 202, 608 can be increased or decreased without changing the membrane shape or size. Increasing volume of the internal cavity 202, 608 cavity may deliver more chemical using less packaging material.

As indicated, the geometry of the container 102, 200, 602 may have a geometry other than cuboid, such as a sphere, cylinder, or irregular. The inner cavity 202, 608 may be a shape different than depicted. The cavity 202, 608 may be cylindrical, spherical, or irregular. The cavity 202, 608 may be symmetrical. In implementations, the inner cavity 202, 608 may be in a center portion of the container 200, 602 but offset toward a wall having the thinnest wall thickness (for example, the membrane or membrane portion).

An embodiment is a wellbore targeted-delivery container including an inner cavity holding a treatment material for a wellbore. The effective density of the wellbore targeted-delivery container having the treatment material is greater than the density of wellbore fluid in the wellbore. The wellbore targeted-delivery container has a wall having a thickness (for example, less than 1 mm) to rupture at a specified wellbore pressure due to a pressure differential between the wellbore and the inner cavity to release the treatment material into contact with the wellbore fluid in the wellbore. The rupture of the wall may expose the inner cavity to wellbore fluid in the wellbore. In certain implementations, a region of the wall has less thickness than other regions of the wall, and where the wall to rupture at the region having the less thickness. In some of those implementations, the region of the less thickness is a thickness in a range of 100 microns to 800 microns, and where the remaining wall regions have a thickness in a range of 1 mm to 10 mm.

Another embodiment is a targeted-delivery system for a wellbore. The targeted-delivery system includes multiple targeted-delivery containers each having an inner cavity holding a treatment material to be directed to a designated section of the wellbore. An effective density of the multiple targeted-delivery containers having the treatment material is greater than density of a wellbore fluid in the wellbore. Each of the multiple targeted-delivery containers has a wall region to fracture due to differential pressure between the designated section of the wellbore and the inner cavity to expose the inner cavity to the wellbore fluid in designated section. The wall region has less thickness than other wall regions of the respective targeted-delivery container. In implementations, the wall region of less thickness has a thickness in a range of 100 microns to 800 microns, and where the other wall regions have a thickness in a range of 1 mm to 10 mm. Lastly, the multiple targeted-delivery containers may include at least 50 targeted-delivery containers to be applied substantially contemporaneously into the wellbore.

Figure 7:
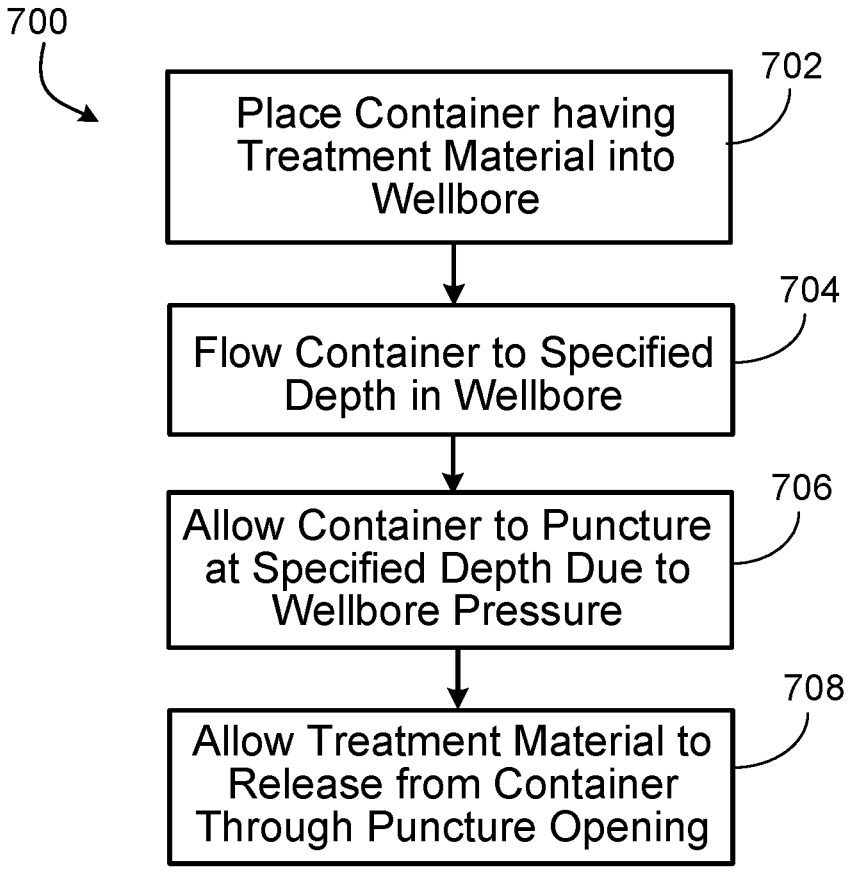
FIG. 7 is a block flow diagram of a method of targeted delivery of a treatment material to a specified depth in a wellbore.

FIG. 7 is a method 700 of targeted delivery of a treatment material to a specified depth in a wellbore. The specified depth may be at a targeted location of the wellbore or designated section of the wellbore.

At block 702, the method includes placing a container having the treatment material into the wellbore. The placing of the container into the wellbore may include dropping or pumping the container into the wellbore. Moreover, multiple containers (for example, greater than 50 containers) may be placed simultaneously into the wellbore. The treatment material may be a solid or fluid. The fluid may be liquid, gas, or supercritical fluid, or any combinations thereof. The treatment may be for treatment applications to the wellbore or adjacent geological formation, as discussed earlier.

At block 704, the method includes flowing the container to the specified depth. In certain embodiments, placing the container into the wellbore involves dropping the container into the wellbore from the Earth surface, and where flowing the container to the specified depth involves allowing the container to migrate downward through wellbore fluid in the wellbore due to a density difference between the container and wellbore fluid. In other embodiments, the flowing of the container to the specified depth includes pumping the container in fluid to the specified depth.

At block 706, the method includes allowing the container to fail (for example, rupture, fracture, or implode) at the specified depth due to the wellbore pressure at the specified depth. In certain embodiments, a wall region of the container has less thickness than other wall regions of the container, and where allowing the container to rupture involves the container rupturing at the wall region having the less thickness. In some embodiments, the wall region of less thickness has a thickness in a range of 100 microns to 800 microns, and where thickness of the other wall regions is in a range of 1 mm to 10 mm. The allowing of the container to rupture may involve a wall of the container failing due to a pressure differential between the wellbore pressure at the specified depth versus a cavity pressure of the container, and where the wall failing gives the rupture opening in the wall. If so, that wall that fails may have a thickness less than other walls of the container. In implementations, the thickness of the wall or a region of the wall that fails is less than 1 millimeter (mm).

At block 708, the method includes allowing the treatment material to release from the container through a rupture opening of the container. As discussed, the container may have an inner cavity holding the treatment material, and where allowing the treatment material to release involves the treatment material releasing from the inner cavity through the rupture opening. The treatment material releasing from the container may include the treatment material migrating from a cavity of the container through the rupture opening to external of the container. The allowing of the treatment material to release may include wellbore fluid flowing through the rupture opening into the container cavity and with the wellbore fluid displacing the treatment material from the container cavity through the rupture opening to external of the container.

Figure 8:
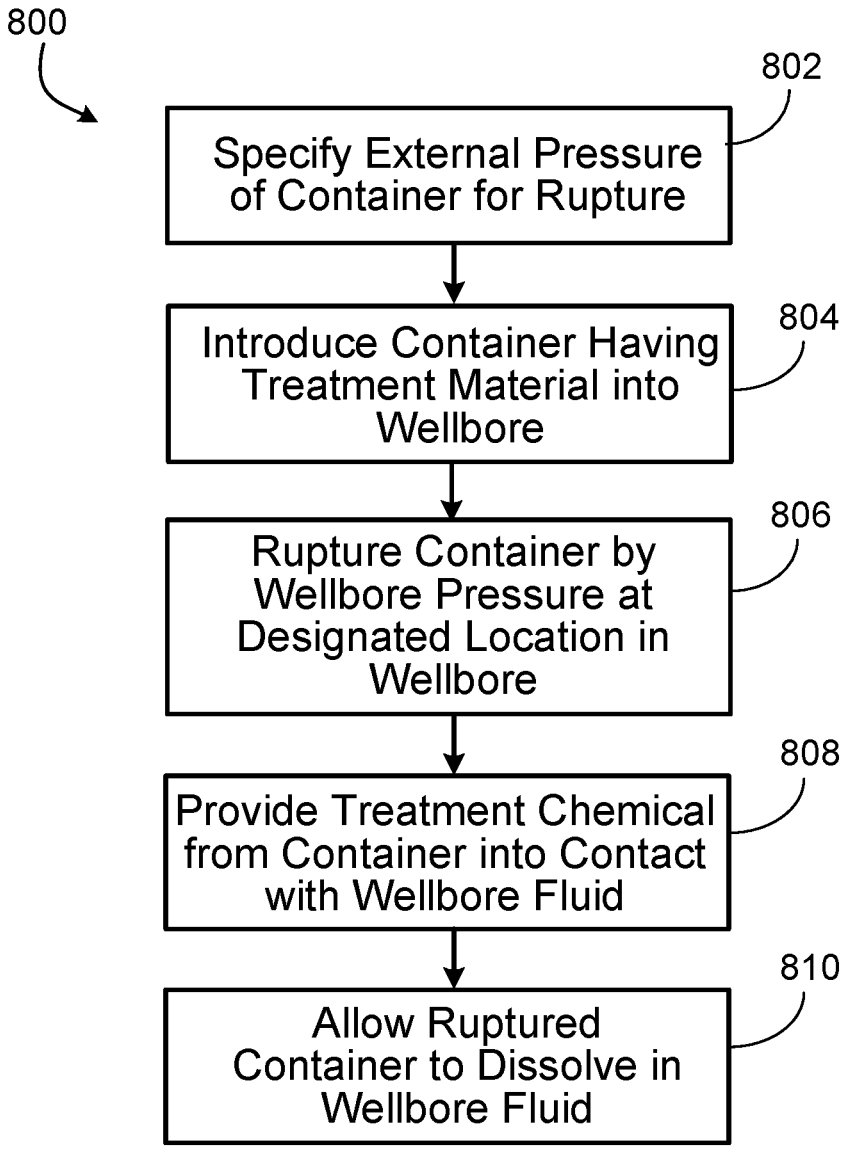
FIG. 8 is a block flow diagram of a method of applying a targeted-delivery container into a wellbore.

FIG. 8 is a method 800 of applying a targeted-delivery container into a wellbore. In some examples, the targeted-delivery container is cuboid in shape. Further, in certain implementations, multiple target-delivery containers are employed. Each container has a side width and side length of less than 10 centimeters. In a particular implementation, at least 50 targeted-delivery containers are employed or applied for a treatment cycle or single treatment. As discussed, the targeted-delivery containers will hold a treatment chemical to be released at the targeted depth to treat that portion of the wellbore or adjacent geological formation. In certain embodiments, the treatment chemical may treat a casing at that portion of the wellbore.

At block 802, the method includes specifying an external pressure for failure (for example, rupture) of the targeted-delivery container(s). The external pressure specified is the wellbore pressure (at the targeted designated location in the wellbore) for the rupture of the targeted-delivery container. The targeted-delivery container(s) may be designed to fail at the specified external pressure. The method may receive the targeted-delivery container(s) as so designed.

At block 804, the method includes introducing the targeted-delivery container storing a treatment chemical into a wellbore fluid in the wellbore. The container may store the treatment material in an inner volume of the container. As discussed, the treatment material may be a solid or fluid, and utilized for treatment applications to the wellbore or adjacent geological formation. In some instances, at least 30 targeted-delivery containers are utilized contemporaneously for the wellbore. For example, the 30 or more targeted-delivery containers may be introduced into the wellbore contemporaneously for the same treatment.

At block 806, the method includes rupturing the targeted-delivery container by wellbore pressure at a designated location (for example, depth or section) in the wellbore. The rupture or failure may be due to pressure differential across a wall of the container. In implementations, the pressure differential may be the wellbore pressure (for example, hydrostatic pressure) minus the pressure in the inner volume of the container housing the treatment material.

At block 808, the method includes providing the treatment chemical from the targeted-delivery container via the rupture into contact with the wellbore fluid at the designated location. For example, the treatment chemical may disperse from the inner volume of the container to external of the container and mix with the wellbore fluid. In some instances, wellbore fluid may rush into the ruptured container to disperse the treatment chemical. In other instances, the treatment chemical may migrate from the inner volume of the container into the wellbore fluid in the wellbore. The treatment chemical may treat that portion of the wellbore or adjacent geological formation. In certain embodiments, the treatment chemical may treat a casing at that portion of the wellbore.

At block 810, the method includes allowing the ruptured container to dissolve in the wellbore fluid. The container can be made of dissolvable material such that the container will dissolve over time (for example, at least 2 days) to eliminate or reduce contamination of the wellbore by the container. In alternate embodiments, at least some of the ruptured container(s) may be produced to the Earth surface at the wellbore and collected.

Figure 9:
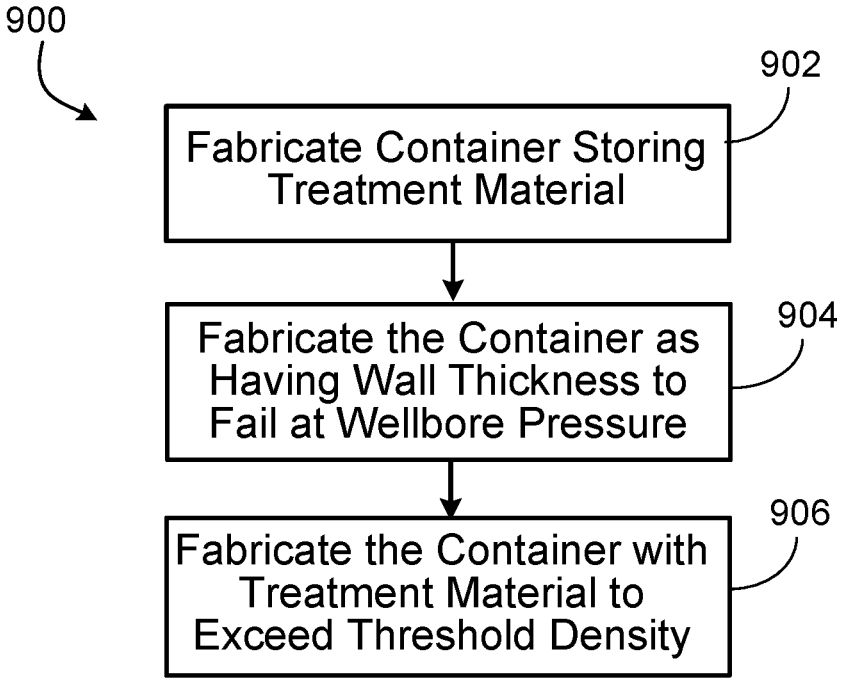
FIG. 9 is a block flow diagram of a method of preparing a targeted-delivery container for a wellbore.

FIG. 9 is a method 900 of preparing a targeted-delivery container for a wellbore. At block 902, the method includes fabricating the targeted-delivery container as having a treatment material in an internal cavity of the targeted-delivery container. The method may include introducing the treatment material for the wellbore into the inner cavity and then sealing the inner cavity.

In some implementations for molding or 3D printing of the containers, the treatment fluid may be incorporated into the cavity of the container. For instance, each container may be molded or 3D printed as having a hole or port for the introduction of treatment material into the container internal cavity. In some implementations, a valve can be employed to facilitate injection of the treatment material into the cavity. After introduction of the treatment material, the port may be closed, for example, by inserting a plug into the port or by melting the port (an area of the container around port) to close the port. In other embodiments, the 3D printer is equipped with a conduit and valve to introduce treatment material into the cavity and then 3D-print closure of the cavity.

The fabricating may include forming a wall of the targeted-delivery container defining the internal or inner cavity or a portion of the inner cavity. The wall may have a thickness (for example, less than 1 mm) to fail (for example, rupture) from wellbore pressure at a specified depth in the wellbore to expose the inner cavity to wellbore fluid in the wellbore.

At block 904, the method includes fabricating the targeted-delivery container having a wall thickness to fail at a specified wellbore pressure to expose the treatment material in the internal cavity to wellbore fluid in the wellbore. The fabricating to give the wall thickness to fail at the specified wellbore pressure may include molding or 3D printing of the targeted-delivery container. A wall region of the targeted-delivery container may have less thickness than other wall regions of the targeted-delivery container, and where the targeted-delivery container to fail at the wall region having the less thickness. In certain implementations, the wall region with the less thickness is a thickness in a range of 100 microns to 800 microns, and where thickness of the other wall regions have a thickness in a range of 1 mm to 10 mm.

At block 906, the method includes fabricating the targeted-delivery container with the treatment material (in the container cavity) in combination as having an effective density greater than density of the wellbore fluid. Therefore, the targeted-delivery container(s) may migrate or drop through wellbore fluid via density difference or gravity. As indicated, forming the wall defining the inner cavity may involve 3D printing or molding such as injection molding or compression molding.

Figure 10:
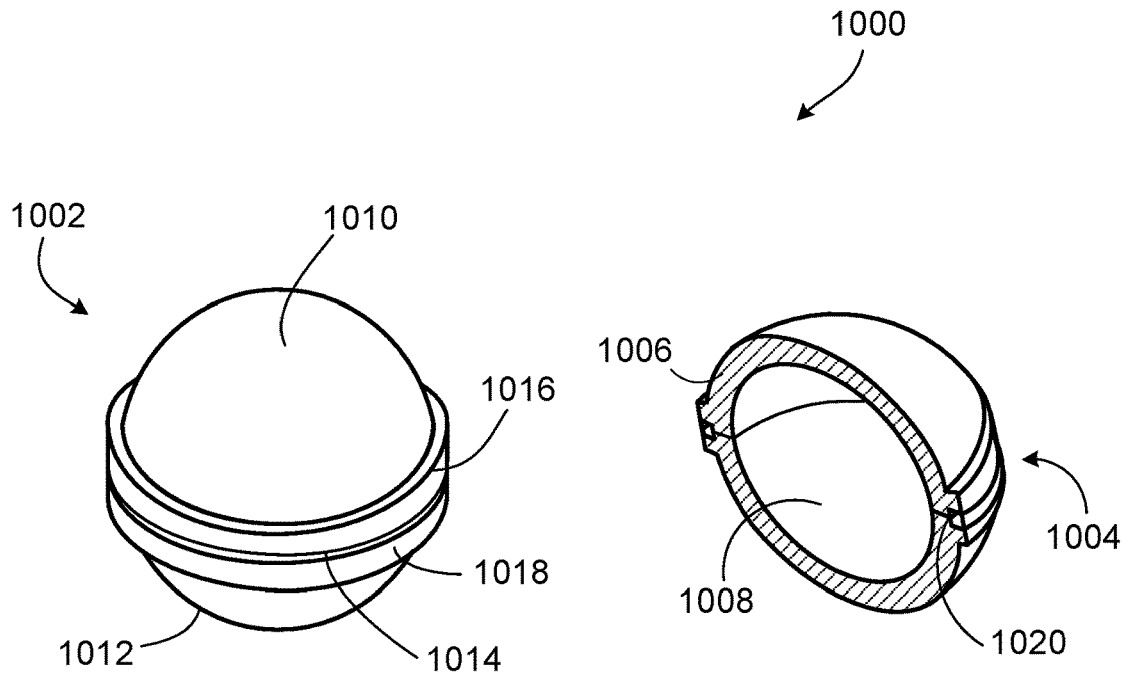
FIG. 10 gives a perspective view and cross-section view of a targeted-delivery container with two hemispherical parts.

FIG. 10 is a targeted-delivery container 1000 that is spherical in shape. Depicted are a perspective view 1002 and a cross-section view 1004. The targeted-delivery container 1000 has a wall 1006 and an inner cavity 1008. Treatment material for delivery to the wellbore may be incorporated into the inner cavity 1008. The nominal outer diameter of the container 1000 may be, for example, in the range of 1 centimeter (cm) to 10 cm.

In the illustrated embodiment, the targeted-delivery container 1000 has two hemispherical portions 1010, 1012 that may be coupled or sealed at an interface 1014 between the two portions 1010, 1012. Each portion 1010, 1012 may have a respective mating flange 1016, 1018 for support at the interface 1014. In an implementation, one or both of the hemispherical portions 1010, 1012 has a groove 1020 at the interface 1014 to receive a mechanical gasket (for example, O-ring) to facilitate sealing at the interface 1014. The gasket may be, for example, an elastomer and have a round cross-section. The gasket inserted or seated in the groove 1020 may be compressed (for example, via flange bolting or flange custom-fit clamp) during assembly of the two portions 1010, 1012 to promote sealing at the interface 1014.

In an implementation in lieu of flanges 1016, 1018, the two hemispherical portions 1010, 1012 may be sealed together by the combination of the O-ring and welding. For material of construction of polymer or plastic, the welding may be friction welding. In other words, the plastic faces at the interface 1014 may be rubbed together until they fuse. Yet another implementation to seal the two hemispherical portions 1010, 1012 with or without flanges 1016, 1018 is by 3D printing or extruding plastic (for example, CPE+) along the seam at the interface 1014 of the two hemispherical portions 1010, 1012.

The treatment material (to be deployed at the targeted location in the wellbore) may be added to the inner cavity 1008 during the assembly and sealing of the two hemispherical portions 1010, 1012. In certain embodiments, a region or area of the wall 1006 has less wall thickness than the remaining wall 1006 so that failure will occur at the region of the wall 1006 with less wall thickness. The thickness of the region of the wall 1006 with less wall thickness can be specified to fail at a given differential pressure across the wall 1006, as generally discussed.

In other embodiments, the wall thickness of the wall 1006 is generally uniform. The wall thickness may be specified so that the wall 1006 fails (fractures) at a specified (design) external pressure exerted on the container 1000 (for example, at the targeted location in the wellbore). Upon such failure of the wall 1006, the spherical container 1000 may fracture into multiple fragments or pieces and thus release the treatment material from the inner cavity 1008 into the wellbore. In certain implementations, the fragments may be carried to the surface with the flow of the wellbore fluid.

The spherical shape of the body of the targeted-delivery container 1000 may provide that the stress capacity on one point of the outer surface of the spherical body is generally equal to the stress capacity of any other point on the outer surface of the spherical body. Therefore, during failure, the body may fracture into multiple smaller pieces in certain instances. In some implementations, multiple pieces resulting from the fracture may be a benefit as compare to an intact body with a ruptured opening.

Figure 11:
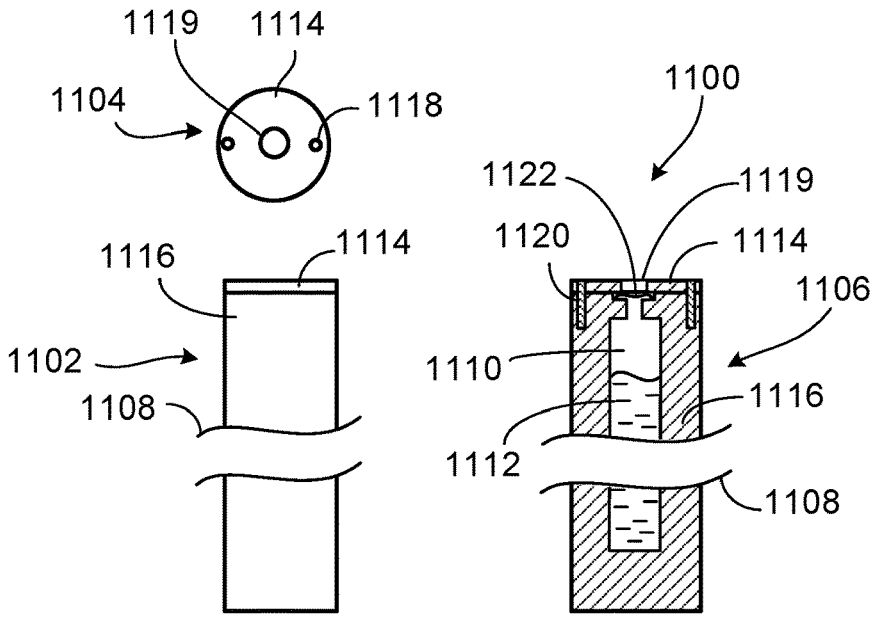
FIG. 11 gives a side view, top view, and cross-section view of a targeted-delivery container that is generally cylindrical.

FIG. 11 is a targeted-delivery container 1100 having a cylindrical shape. Depicted are a side view 1102, a top view 1104, and a cross-section view 1106. The continuation curves 1108 indicate that the container 1100 may be fabricated with an extended length to hold a greater volume of treatment material without altering the cylinder diameter and desired rupture pressure. A cylindrical design may give an advantage of the option to adjust the volume of the internal cavity 1110 during manufacture of the container 1100 by changing the length of the cylinder without changing the external pressure capacity.

The container 1100 may have the internal cavity 1110 to hold a treatment material 1112 for the wellbore. The container 1100 can have a top or lid 1114 (for example, a plate) to mate to the shell or cylindrical body 1116 of the container 1100. In some implementations, the lid 1114 may have bolt holes 1118. If so, bolting 1120 (for example, threaded) may couple the lid 1114 to the body 1116.

To release the treatment material 1112 from the cavity 1110 in the wellbore, the container 1100 may have a failure component 1122, such as a membrane or rupture disc. The lid 1114 may be plate that holds an outer rim of the failure component to secure the failure component 1122 in place as installed. The lid 1114 may have a hole or opening 1119 in a center portion of the lid over the failure component 1122 so that the lid 1114 does not block or interfere with failure (rupture or implosion) of the rupture disc or membrane. The membrane rupture disc may be set or configured to rupture (implode) at a predetermined external pressure or at a specified pressure differential across the rupture disc.

Upon implosion of the failure component 1122 of the container 1100 deployed in a wellbore, the treatment material 1112 may be released from the inner cavity 1112 into the wellbore. The treatment material 1112 may flow from the inner cavity 1112 through the opening (formed or exposed by the implosion or rupture of the failure component 1122) into the wellbore.

In implementations, the hoop stress on side and bottom portions of the body 1116 generally withstand greater external pressure than the membrane or the rupture disc. Thus, the failure component 1122 may implode to expose the inner cavity 1110 (and the stored treatment material 1112) to the wellbore. Lastly, as mentioned, the length of the container 1100 can be varied in manufacture to change the volume of the internal cavity 1110 without altering the container 1100 diameter or desired rupture pressure.

Figure 12:
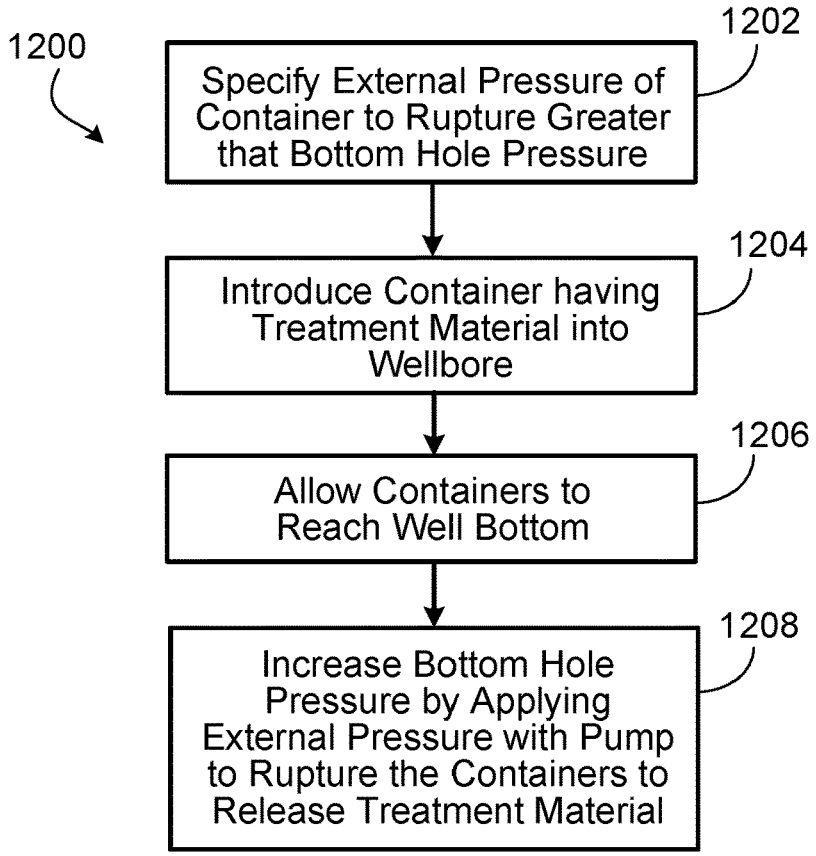
FIG. 12 is a block flow diagram of a method of targeted delivery of a treatment material to a bottom portion of a wellbore.

FIG. 12 is a method 1200 of targeted delivery of a treatment material to the bottom a wellbore (or to a bottom portion of the wellbore). The bottom hole pressure of the well may be estimated based on well pressure data (for example, wellhead pressure measurements) and hydrostatic calculations.

At block 1202, the method includes specifying the external pressure for failure of a targeted-delivery container as greater than the bottom hole pressure or the pressure at the bottom portion of the well or wellbore. The targeted-delivery container(s) may be fabricated or prepared for failure (rupture) at the specified external pressure. Thus, the container is designed or set to fail at a pressure larger than the greatest pressure present inside the well. In implementations, the specified or designed failure pressure can be 50 pounds per square inch (psi) to 1000 psi greater than the pressure at the well bottom.

At block 1204, the method includes introducing the targeted-delivery container(s) into the wellbore. The targeted-delivery container may hold treatment material to be released and dispersed at a target location in the wellbore. The target location may be the bottom or bottom portion of the wellbore or well.

At block 1206, the method includes allowing the container(s) to reach the well bottom. The effective density of the containers may be greater than the wellbore fluid. Therefore, the containers may flow by density difference for their descent to the bottom of the well.

At block 1208, the method includes increasing the bottom hole pressure via a pump to rupture the containers to release the treatment material from the containers. The treatment material may mix with the wellbore fluid at the bottom portion of the well. The method 1200 may be applied, for example, in treatment of the rock formation without affecting the wellbore casing or production tubing.

Figure 13:
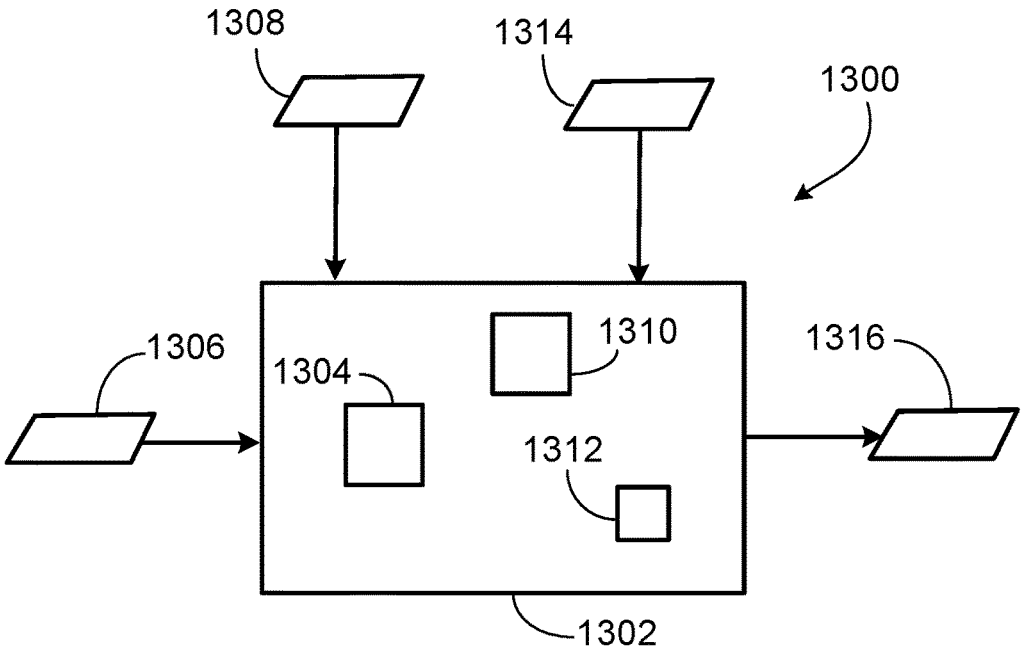
FIG. 13 is a block diagram of a manufacturing system to fabricate a target-delivery container.

FIG. 13 is a manufacturing system 1300 having equipment 1302 to fabricate a targeted-delivery container. The equipment 1302 may include a fabrication system 1304, such as 3D printer or injection mold, to receive a material 1306 (for example, a polymer) to form the targeted-delivery container from the material 1306. For the implementation of the fabrication system 1304 having an injection mold, the mold may be shaped form an internal cavity and container walls having specified wall thicknesses for the targeted-delivery container. For a fabrication system 1304 having a 3D printer, the computer model driving the 3D printer may be configured or set (programmed) to form the internal cavity and container walls having specified wall thicknesses for the targeted-delivery container.

The equipment 1302 may include a conduit to receive a treatment material 1308 into the internal cavity of the targeted-delivery container. The treatment material 1308 may be a fluid for treating a wellbore. The treatment material 1308 may be incorporated (added) into the container internal cavity in the fabrication system 1304. Alternatively, the treatment material 1308 may be added to the formed container outside of the fabrication system 1304, such as in an assembly area or staging area 1310.

In some implementations, the system 1300 may include tools 1312, such as machine tools and hand tools. The tools 1312 (for example, including wrenches) may be employed to assemble a secondary piece 1314 (for example, rupture disc) onto the targeted-delivery container and also to assemble flanges, bolting, gaskets, and lids of the containers. Lastly, a product of the manufacturing system 1300 may be the fabricated targeted-delivery container 1316 having treatment material for a wellbore.

A number of implementations have been described. Nevertheless, it will be understood that various modifications may be made without departing from the spirit and scope of the disclosure.

What is claimed is:

1. A method of targeted delivery of treatment material to a specified depth in a wellbore in a geological formation, comprising:

placing a container comprising the treatment material into the wellbore, wherein a wall region of the container comprises less thickness than other wall regions of the container, and wherein the container does not comprise a rupture disc;

flowing, without aid of a pump, the container to the specified depth;

allowing the container to rupture at the specified depth due to the wellbore pressure at the specified depth, wherein the container does not dissolve in the wellbore;

allowing the treatment material to release from the container through a rupture opening of the container, wherein allowing the container to rupture comprises the container rupturing at the wall region having the less thickness; and treating the wellbore at the specified depth with the treatment material, wherein treating the wellbore at the specified depth with the treatment material facilitates production of crude oil or natural gas, or both, through the wellbore.

2. The method of claim 1, wherein placing the container into the wellbore comprises dropping the container into the wellbore from an Earth surface, wherein flowing the container to the specified depth comprises allowing the container to migrate downward through wellbore fluid in the wellbore due to a density difference between the container and wellbore fluid, and wherein treating the wellbore at the specified depth with the treatment material facilitates production of crude oil or natural gas, or both, through the wellbore comprises inhibiting corrosion, addressing loss circulation, or promoting primary cementing, or any combinations thereof.

3. The method of claim 1, wherein placing the container into the wellbore comprises placing at least 30 containers simultaneously into the wellbore, each container comprising the treatment material, and wherein allowing the container to rupture comprises allowing the at least 30 containers to rupture contemporaneously at the specified depth due to the wellbore pressure at the specified depth.

4. The method of claim 1, wherein allowing the container to rupture comprises the wall region comprising the less thickness failing due to a pressure differential between the wellbore pressure at the specified depth versus a cavity pressure of the container, wherein the wall region comprising the less thickness failing gives the rupture opening in the wall.

5. The method of claim 4, comprising:

determining hydrostatic pressure at the specified depth to facilitate the targeted delivery of the treatment material to the specified depth; and specifying that the container rupture at an external pressure that is the hydrostatic pressure, and wherein the wall region comprising the less thickness is less than 1 millimeter (mm).

6. The method of claim 5, comprising configuring the container to rupture at the wall region due to an amount of the hydrostatic pressure at the specified depth in response to specifying that the container rupture due to the hydrostatic pressure at the specified depth, wherein the container releases the treatment material through the rupture opening from a cavity of the container, and wherein the wellbore pressure at the specified depth is the hydrostatic pressure at the specified depth.

7. The method of claim 1, comprising producing the container as ruptured from the wellbore to Earth surface and collecting at the Earth surface the container as ruptured.

8. The method of claim 1, wherein the treatment material releasing from the container comprises the treatment material migrating from a cavity of the container through the rupture opening to external of the container.

9. The method of claim 1, wherein allowing the treatment material to release comprises wellbore fluid flowing through the rupture opening into a cavity of the container, the wellbore fluid displacing the treatment material from the cavity through the rupture opening to external of the container.

10. The method of claim 1, wherein the container is configured to rupture at design external pressure greater than a bottom hole pressure of the wellbore.

11. The method of claim 10, wherein the design external pressure for rupture of the container is in a range of 50 pounds per square inch (psi) to 1000 psi greater than the bottom hole pressure.

12. A wellbore targeted-delivery container comprising:

an inner cavity holding a treatment material for a wellbore to treat the wellbore at a designated depth with the treatment material to facilitate production of crude oil or natural gas, or both, through the wellbore, wherein the wellbore targeted-delivery container holding the treatment material is configured to flow to the designated depth in the wellbore without aid of a pump, wherein an effective density of the wellbore targeted-delivery container having the treatment material is greater than density of wellbore fluid for the targeted-delivery container to flow to the designated depth in the wellbore without aid of a pump, and wherein the wellbore targeted-delivery container is configured to not dissolve in the wellbore; and a wall configured to rupture at a specified wellbore pressure due to a pressure differential between the wellbore and the inner cavity to release the treatment material into contact with the wellbore fluid in the wellbore, wherein a region of the wall comprises less thickness than other regions of the wall, wherein the wall configured to rupture comprises the wall configured to rupture at the region having the less thickness, and wherein the wellbore targeted-delivery container does not comprise a rupture disc.

13. The wellbore targeted-delivery container of claim 12, wherein the region comprises a thickness in a range of 100 microns to 800 microns, and wherein the other regions comprise a thickness in a range of 1 millimeter (mm) to 10 mm.

14. The wellbore targeted-delivery container of claim 12, wherein the region comprises a thickness less than 1 millimeter (mm), wherein rupture of the wall to expose the inner cavity to wellbore fluid in the wellbore, wherein the specified wellbore pressure is hydrostatic pressure in the wellbore at the designated depth, and wherein to treat the wellbore at the designated depth with the treatment material to facilitate production of crude oil or natural gas, or both, through the wellbore comprises to inhibit corrosion, address loss circulation, or promote primary cementing, or any combinations thereof.

* * * * *